United States Patent [19]

Kelley

[11] Patent Number: 4,938,607

[45] Date of Patent: Jul. 3, 1990

[54] SACK-FORMING SHEET

[76] Inventor: Patrick W. Kelley, 311 Cook St., Hackettstown, N.J. 07840

[21] Appl. No.: 86,404

[22] Filed: Aug. 17, 1987

[51] Int. Cl.[5] ..... B65D 30/00

[52] U.S. Cl. ..... 383/4; 383/75; 190/1

[58] Field of Search ..... 383/4, 75; 190/1

[56] References Cited

U.S. PATENT DOCUMENTS

| | | | |
|---|---|---|---|
| 1,237,628 | 8/1917 | Ford | 383/4 X |
| 1,861,864 | 6/1932 | Kennedy | 383/75 |
| 1,902,368 | 3/1933 | Johns | 383/4 |
| 2,766,797 | 10/1956 | Cowen | 383/4 X |
| 3,196,757 | 7/1965 | Samways | 383/75 X |
| 3,738,568 | 6/1973 | Ruda | 383/75 |
| 3,920,180 | 11/1975 | Meier | 383/75 |
| 4,337,812 | 7/1982 | Trinkner | 383/4 |
| 4,723,327 | 2/1988 | Smith | 5/82 R |
| 4,738,545 | 4/1988 | Westgor | 383/4 |

*Primary Examiner*—Stephen Marcus
*Assistant Examiner*—Nova Stucker
*Attorney, Agent, or Firm*—Thomas E. Kelley

[57] ABSTRACT

Thermoplastic sheets having a draw tape within peripheral hems are gatherable into sacks. Such sheets are useful for disposable kitchen liners, tablecloths, leaf-collecting bags, etc.

9 Claims, 2 Drawing Sheets

SACK-FORMING SHEET

Disclosed herein are inventions relating to thermoplastic sheets adapted to be formed into sacks. More particularly disclosed are inventions relating to thermoplastic sheets having draw tapes within its hems, along with methods of making and using such sheets and the sacks formable therefrom.

BACKGROUND

Plastic bags having draw strings, e.g. as illustrated in U.S. Pat. No. 3,013,597 and 4,558,463, provide a great advantage in closing and securing bags, especially trash bags as compared to bags requiring other types of closure, e.g. string or twist ties. However, except when such bags are supported, e.g. in a rigid container, it is often difficult to fill such bags especially with noncompliant articles such as leaves or kitchen scraps. In such cases it is often advantageous to collect such leaves or scraps on a flat sheet, gather the edges of the sheet to contain the fill, and dump the fill or the sheet with the fill into a trash bag. An object of this invention is to provide a flat sheet that is especially useful not only in the collection of articles, e.g. trash, but which can also secure such articles as in a sack without the need for redundant containerization.

Attempts to provide gatherable sheets which have been proposed for a variety of purposes do not advantageously meet the objects of this invention. For instance, circular sheets which are gatherable into sacks are disclosed in U.S. Pat. No. 3,475,767 which provides a sanitary disposable receiver, e.g. for liquid wastes such as body fluids, and in U.S. Pat. No. 4,337,812 whch provides a combined picnic basket/table cloth. Although such circular sheets having drawstrings in their peripheral hems are readily gatherable into sacks, it is difficult to produce such sheets from inexpensive polymeric materials, such as polyolefins. Rectangular sheets having cords in their hems have been provided for a variety of uses, e.g. as sails, clothing, tarpaulins etc.; see, for instance U.S. Pat. No. 4,590,715. Because of the stress typically applied to the hems in such uses, such sheets have generally been fabricated from materials of substantial durability and toughness and consequently are not usually inexpensive or considered expendable.

It has been discovered that flat sheets adapted to be gathered into sacks by drawstrings within hems can be provided from thermoplastic film by a process that is readily adapted to automatic sheet handling methods and apparatus, thus affording the commercial feasibility for disposable containers which is lacking in devices of the prior art.

SUMMARY OF THE INVENTION

This invention provides rectangular, thermoplastic sheets adapted to be formed into sacks. Such sheets have on each peripheral edge a continuous hem with a draw tape enclosed therein.

DESCRIPTION OF PREFERRED EMBODIMENTS

This invention provides a rectangular, e.g. often preferrably square, thermoplastic sheet which is adapted to be formed into a sack. With reference to the embodiment illustrated in FIG. 1 such a sheet 1 has on its peripheral edges, surrounding a central section 2, a continuous hem 3 with a draw tape 4 enclosed therein. As used herein the term "hem" refers to a border of a sheet such as is formed by doubling back and securing the border to the sheet, thereby forming a substantially enclosed channel. The hem will be generally tubular and most often substantially collapsed tubular.

In preferred embodiments the draw tape in each peripheral hem will be a single continuous draw tape, i.e. the sections of draw tape will be joined at the corners of the sheet. Such continous tape will preferrably have a length less than the maximum peripheral length of said hems; that is, when the sheet is laid out flat, the tape will not extend beyond the perimeter of the sheet.

Figure 1:
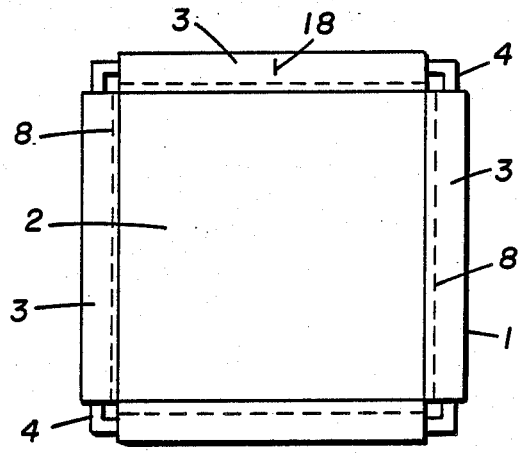
FIG. 1 illustrates an embodiment of a sheet of this invention.

In the embodiment illustrated in FIG. 1 the hems of the sheet are open at the corners. Such sheets with open corners are often preferred because of ease of manufacture as well as ease of use, e.g. the tapes are readily accessible for forming the sheet into a sack. In other cases it may be desirable to provide the sheet with closed corners as illustrated in FIG. 2 where tape 4 within hem 3 has a right angle turn 5 within closed corner piece 6 which can be torn away from the sheet at perforations 7.

Figure 2:
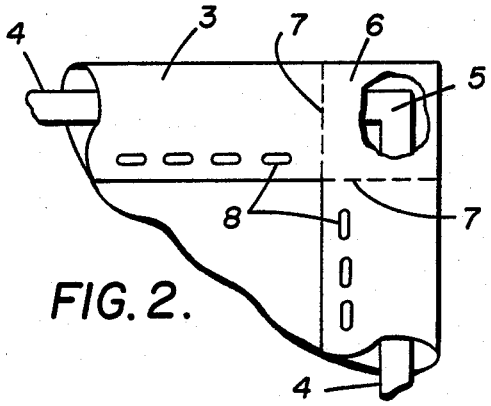
FIG. 2 illustrates a partial cutaway view of one embodiment of a sheet of this invention having a perforated, tear-away corner.
Figure 3:
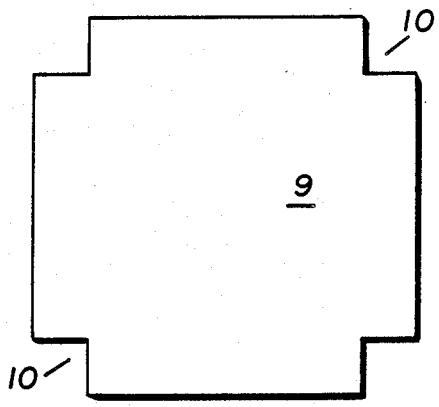
FIGS. 3 and 4 illustrates embodiments of blank stock useful in forming sheets of this invention.
Figure 4:
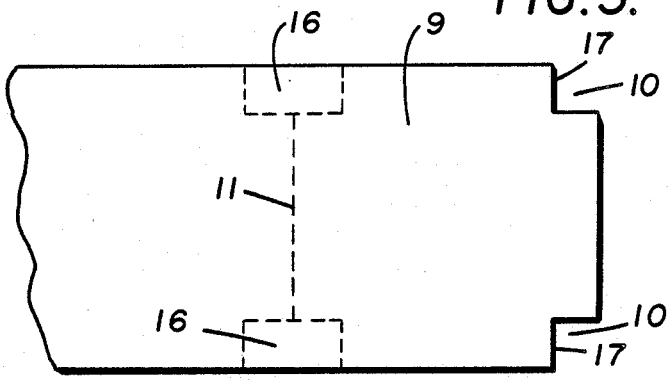

With further reference to FIGS. 1 and 2 there is shown a sealing bead 8 which serves to form the hem. Such sealing bead can be a continuous bead along each hem or a series of short beads as generally illustrated. Such beads can be provided by applying heat to fuse the doubled-back borders of the sheet which form the hem. Optional sealing bead 18 serves to fuse the tape to the hem at about the midlength of the hem One method of forming the sheet according to this invention can be described with reference to FIGS. 3, 4, and 5. In FIG. 3 there is shown a blank square sheet 9 having square cutouts 10 in each of its corners. Such blank sheets can be provided separately or as roll stock as illustrated in FIG. 4, where separate sheets can be provided by cutting at pattern line 11, e.g. by hot cutting bar, knife, laser and such. The blank sheets can comprise any of a variety of thermoplastic materials which are readily fused by heat, e.g. as applied by a hot bar, without decomposition of the thermoplastic material or of the integrity of the sheet.

Preferred thermoplastic materials comprise the polyolefins such as high density polyethylene, low density polyethylene, polypropylene, etc. Where strength of the sack formed from the sheet is an especially desired characteristic, e.g. in the case of large sheet which may be used in yard work such as in collecting leaves, a preferred thermoplastic material will be linear, low density polyethylene. In some cases it may be desirable to provide the sheet as a laminate of two or more films of the same or different thermoplastic materials.

The tape can comprise similar thermoplastic materials and will preferrably have substantial tensile strength, e.g. be relatively non-ductile when drawn with commonly applied force to form the sheet into a sack. Illustrative thermoplastic materials of such tape are nylons such as nylon 6 and nylon 6,6, polyesters such as polyethylene terephthalate and polyolefins such as, preferably, high density polyethylene.

Figure 5:
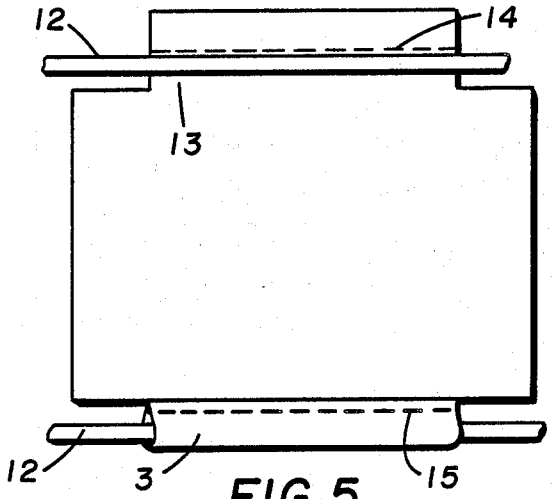
FIG. 5 illustrates a sheet of blank stock partially fabricated into one embodiment of a sheet of this invention.

As shown in FIG. 5 a blank sheet 9 can be overlaid with two lengths of tape 12 on the inner half of a hem section 13. The hem section is folded along mid-line 14 to enclose tape 12 in a hem 3 which can be sealed along bead line 15 by pressing with a hot surface. In a like manner tape is enclosed within hems around the remaining periphery of the sheet, and the ends of the individual tapes are cut and fused to provide a continuous tape within the hems of a sheet as illustrated in FIG. 1. In some cases it is desirable to also fuse the tape, e.g. at the mid-length thereof, to the hem to enhance the sack forming character of the sheet.

In an alternative, but not illustrated, embodiment hems can be formed from hem sections which are separate narrow strips of thermoplastic material. Such separate strips will be about as long as the edge of the sheet and wide enough to accommodate a draw tape between hem-forming sealing beads which secure the strips to the border of the sheet at both the inner and outer edges of the strip. In another alternative embodiment sheets comprising two or more layers can be fabricated by laminating multiple layers, e.g. in the shape illustrated in FIG. 3. Hems enclosing draw tapes can be formed by fusing the laminate at the border on both sides of draw tapes between the sheets.

With reference to FIG. 4, in a preferred method of forming the sheets of this invention, as thermoplastic film is pulled from a roll across a conveyor, the film is momentarily stopped to apply a cutter to remove rectangular or semicircular sections, e.g. rectangular sections 16. The leading edge 17 of hem sections is passed through a sheet folder which forms and seals a hem around an overlaid tape on opposing sides of the travelling sheet. When the sheet is next momentarily stopped to cut the succeeding sections 16, a cutter separates the half-hemmed sheet along pattern line 11. The half-hemmed sheet is transferred to a right-angled conveyor for forming the tape-enclosing hems on the remaining two edges. The tape is then trimmed and fused to provide a continuous tape. The fully formed sheets are readily folded and packaged.

Figure 6:
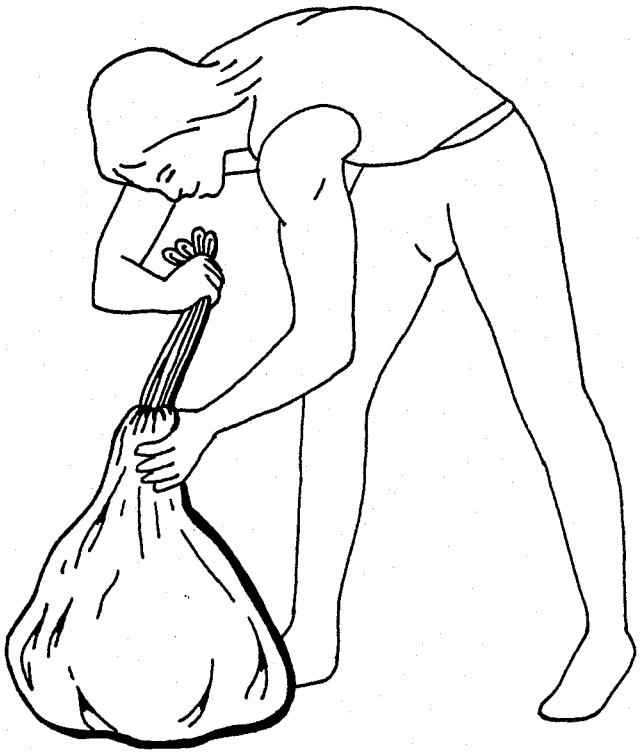
FIG. 6 illustrates a method of forming a sheet of this invention into a sack.

The sheets of this invention are useful for collecting a variety of items, e.g. by dropping, raking or sweeping, onto an extended sheet. The tapes at the corners are drawn to gather the hems forming a sack, as illustrated in FIG. 6, which is useful for transporting and/or disposing of the collected items. Sheets of this invention of a small size, e.g. about 30 cm square, are useful as countertop liners to colect scraps from food preparation. Larger sheets, e.g. about 50 cm square or 40 cm by 60 cm, are especially useful as cat litter box liners. Even larger sheets, e.g. about 2 m square, are useful as disposible tablecloths to gather up disposible cups, plates, etc. Such sheets can be decorated for various festive occasions or be provided with a non-glossy surface amenable to consumer customized decoration, e.g. by crayons, finger paint and the like. Still larger sheet, e.g. about 4 m square, are useful as tarpaulins or for gatering and disposing of yard waste such as leaves.

While specific embodiments of this invention have been described, it should be apparent to those skilled in the art that various modifications thereof can be made without departing from the true spirit and scope of the invention. Accordingly it is intended that the following claims cover all such modifications within the full inventive concept.

What is claimed is:

1. A flat-lying, flexible rectangular thermoplastic sheet having on each of its four sides a hem of a length less than the length of said side, wherein each of said hems has a continuous tape segment extending therein, wherein opposing segments are parallel and adjacent segments are perpendicular to each other, wherein each of said segments intersects adjacent segments and is fused to adjacent segments at the intersection thereof to form a continuous draw tape adapted to forming said sheet into a sack wherein the length of said draw tape is less than the peripheral length of said sheet.

2. A sheet according to claim 1 wherein said segment is fused to said hem at about the mid-length of said hem.

3. A sheet according to claim 1 wherein said sheet comprises polyethylene or polypropylene.

4. A sheet according to claim 1 which is substantially square.

5. A sack formed from a flat sheet according to claim 1.

6. A flat-lying, flexible, rectangular thermoplastic sheet having on its periphery a continuous hem with a continuous draw tape enclosed therein wherein said sheet is perforated at the corners thereof, said corners being adapted to be torn from said sheet to allow said draw tape to be pulled to form said sheet into a sack.

7. A sheet according to claim 6 wherein said segment is fused to said hem at about the mid-length of said hem.

8. A sheet according to claim 6 wherein said sheet comprises polyethylene or polypropylene.

9. A sheet according to claim 6 which is substantially square.

* * * * *